US005595437A

United States Patent [19]

Rapisarda et al.

[11] Patent Number: 5,595,437

[45] Date of Patent: Jan. 21, 1997

[54] HAIRBRUSH WITH MOTION SENSITIVE LIGHT

[76] Inventors: Carmen C. Rapisarda, 2650 Myrtle Ave. #B-7, Monrovia, Calif. 91016; Thomas C. Rapisarda, 9334 Wampler Ave., Pico Rivera, Calif. 90660

[21] Appl. No.: 584,305

[22] Filed: Jan. 11, 1996

[51] Int. Cl.[6] ..... F12V 33/00

[52] U.S. Cl. ..... 362/109; 362/32; 362/115; 362/276; 362/802; 15/105

[58] Field of Search ..... 362/32, 109, 115, 362/276, 802, 253, 800; 15/105, 159.1, 167.1, 106; 132/120

[56] References Cited

U.S. PATENT DOCUMENTS

| | | | |
|---|---|---|---|
| 1,259,169 | 3/1918 | Train | 362/115 |
| 2,397,757 | 4/1946 | Schwedersky | 362/32 |
| 2,688,971 | 9/1954 | Daniels et al. | 362/109 |
| 2,798,148 | 7/1957 | Di Lizio et al. | 362/103 |
| 4,768,531 | 9/1988 | Broussard | 132/313 |
| 4,779,173 | 10/1988 | Carr et al. | 362/109 |
| 5,160,194 | 11/1992 | Feldman | 362/109 |
| 5,339,479 | 8/1994 | Lyman | 362/109 |

*Primary Examiner*—Stephen F. Husar
*Assistant Examiner*—Thomas M. Sember
*Attorney, Agent, or Firm*—Edgar W. Averill, Jr.

[57] ABSTRACT

A hairbrush which is made from a transparent material which has a motion sensitive light embedded in it. As the hairbrush is used or carried, the light flashes on and off. Preferably the light source is a light emitting diode and the battery is a wafer battery.

4 Claims, 1 Drawing Sheet

Fig. 1
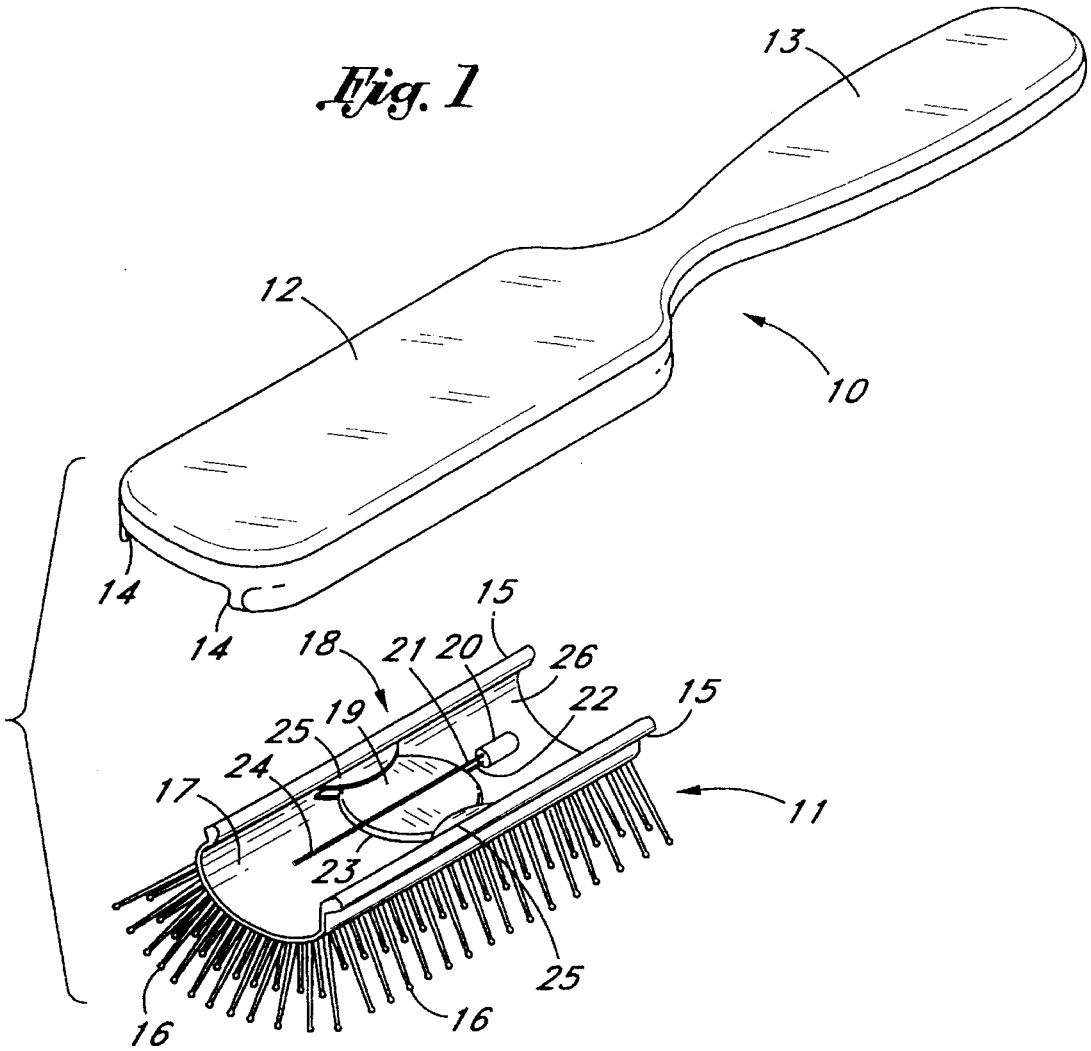
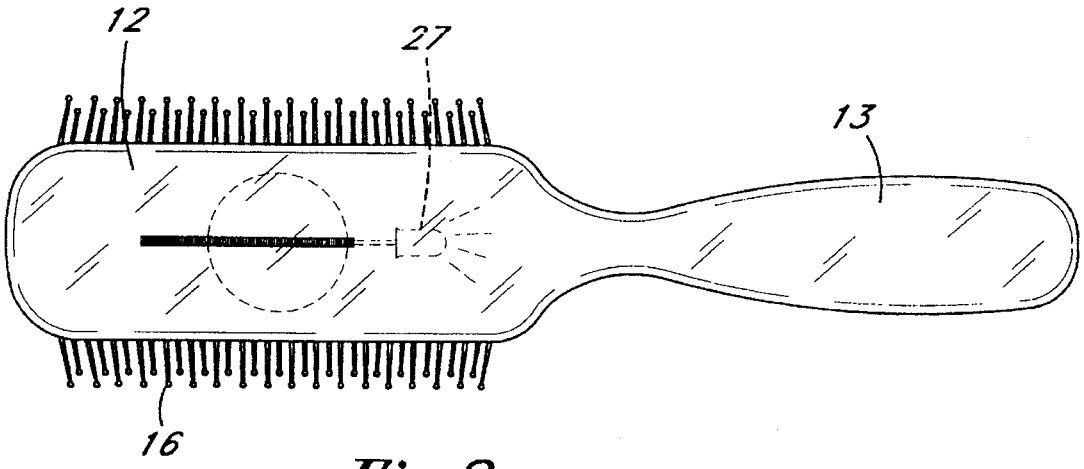
Fig. 2

HAIRBRUSH WITH MOTION SENSITIVE LIGHT

BACKGROUND OF THE INVENTION

The field of the invention is hairbrushes and the invention relates more particularly to hairbrushes sold to children or young adults. One of the applicants is the inventor of the modern lighted tennis shoe which has had a surprising amount of success. The applicants have recognized that children and young adults enjoy the attention created by a motion sensitive light.

One of the applicants is the inventor of U.S. Pat. Nos. 5,477,435 and 5,482,493 and one of the inventors of U.S. Pat. No. 5,285,586. One of the applicants is also the inventor in pending U.S. application Ser. No. 08/437,617 which is incorporated herein by reference for its teaching of a particular style of motion sensitive light useful with the present invention.

In addition to lighted shoes, a lighted hairbrush is shown in U.S. Pat. No. 2,688,971. This light is an infrared or ultraviolet projecting light used for setting as well as brushing the hair and is energized by being plugged into a wall outlet. A lighted toothbrush is shown in U.S. Pat. No. 4,779,173. Once again, the light is not motion sensitive, but instead, turned on and off by switch 20.

Another toothbrush with lights is shown in U.S. Pat. No. 5,339,479. This toothbrush includes an electronic circuit which is turned on by a switch and has a multiplicity of lights and will also produce sounds.

Motion sensitive lights have been used in jewelry such as earrings and hair bows as shown in U.S. Pat. No. 2,798,148. They have also been used in jewelry as shown in U.S. Pat. No. 2,854,563.

BRIEF SUMMARY OF THE INVENTION

It is an object of the present invention to provide an attractive hairbrush which will cause a light to blink within it as it is being used or carried.

The present invention is for a hairbrush having a body including a handle and a back and a plurality of bristles. The body is fabricated from a transparent material and a battery energized light source is positioned within the body. The battery energized light source includes switch means which are momentarily turned on and off by movement of the hairbrush. Preferably the light source is a light emitting diode and the battery is a wafer battery.

DESCRIPTION OF THE DRAWINGS

FIG. 1 is an exploded perspective view of the hairbrush with a motion sensitive light of the present invention.

FIG. 2 is a top view thereof.

DESCRIPTION OF THE PREFERRED EMBODIMENTS

A hairbrush is shown in exploded perspective view in FIG. 1 and generally includes a body 10 and a bristle assembly 11. The body portion 10 has a back 12 and a handle 13 and is fabricated from a light transmitting material which may either be transparent or translucent. The back has a pair of rails 14 which mate with a pair of rails 15 on bristle assembly 11. Bristle assembly 11 is shown as an injection molded unitary piece wherein the bristles 16 extend outwardly from a backing plate 17. Backing plate 17 is generally concave as shown in FIG. 1 and forms a receiving area for the motion sensitive light assembly 18. Preferably backing plate 17 is translucent so that light may show through it. Motion sensitive light assembly 18 includes a wafer battery 19 which supports an LED 20 which has an upper lead 21 and a lower lead 22. Lower lead 22 is in electrical contact with the lower pole 23 of wafer battery 19. Upper lead 21 supports an insulative length of spaghetti tubing not shown which in turn supports a highly flexible spring 24. The flexible spring is insulated from contact with all but a short length at the end of LED lead 21. Spring 24 is in electrical contact with the other pole 23' of wafer battery 19. As spring 24 moves back and forth, it periodically touches the end of lead 21, completes a circuit and causes LED 20 to flash on and off. The details of construction of this particular motion sensitive light is described in application Ser. No. 08/437,617 which application is incorporated herein by reference. While this particular light source is especially useful in practice of the present invention any motion sensitive light assembly can be used.

The backing plate 17 is molded with a pair of battery holding clamps 25 which securely hold the motion sensitive light assembly in the concave portion 26 of backing plate 17. Once the motion sensitive light assembly is snapped in place the backing plate 17 is slid into the rails 14 of back 12 and a transparent end cap, not shown, is glued in place to complete the assembly.

The hairbrush of the present invention is shown in top view in FIG. 2 where the light emitting portion 27 of LED 20 can be seen through the transparent back 12 of the hairbrush.

The result of the use of a motion sensitive light in a light transmitting hairbrush is quite spectacular and attention getting. The use of the hairbrush provides an appropriate amount of movement to energize the motion sensitive light. The result is a pleasant and attractive intermittent lighting effect. While the drawings show a motion sensitive light in the back 12, it could, of course, be located in a transparent or translucent handle 13.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A hairbrush having a body including a back and a handle and a plurality of bristles, said body being fabricated from a light transmitting material, wherein the improvement comprises:

a battery energized light source positioned within said body, said battery energized light source including a battery, switch means and a light source, and wherein said switch means is momentarily turned on and off by movement of said hairbrush.

2. The hairbrush of claim 1 wherein said light source is a light emitting diode.

3. The hairbrush of claim 1 wherein said switch means is in an off position when the hairbrush is at rest.

4. The hairbrush of claim 1 wherein said bristles are formed from a translucent polymer integrally with a backing plate and said backing plate has a bristle surface and a back surface and said back surface forms a concave area and said battery, switch means and light source are held in said concave area.

* * * * *